US010973356B2

(12) United States Patent
Choi

(10) Patent No.: US 10,973,356 B2
(45) Date of Patent: Apr. 13, 2021

(54) SHADE SUSPENSION APPARATUS

(71) Applicant: Jong Oh Choi, Seoul (KR)

(72) Inventor: Jong Oh Choi, Seoul (KR)

( * ) Notice: Subject to any disclaimer, the term of this patent is extended or adjusted under 35 U.S.C. 154(b) by 123 days.

(21) Appl. No.: 16/091,994

(22) PCT Filed: Sep. 28, 2017

(86) PCT No.: PCT/KR2017/010813
§ 371 (c)(1),
(2) Date: Oct. 7, 2018

(87) PCT Pub. No.: WO2018/066888
PCT Pub. Date: Apr. 12, 2018

(65) Prior Publication Data

US 2019/0216250 A1 Jul. 18, 2019

(30) Foreign Application Priority Data

Feb. 24, 2017 (KR) ..... 10-2017-0024673

(51) Int. Cl.

| | |
|---|---|
| ***A47H 7/02*** | (2006.01) |
| ***A47H 1/142*** | (2006.01) |
| ***A47H 1/122*** | (2006.01) |
| ***A47H 1/124*** | (2006.01) |

(52) U.S. Cl.
CPC ..... *A47H 7/02* (2013.01); *A47H 1/122* (2013.01); *A47H 1/124* (2013.01); *A47H 1/142* (2013.01)

(58) Field of Classification Search
CPC . A47H 7/02; A47H 7/00; A47H 1/122; A47H 1/124; A47H 1/18; A47H 1/19; A47H 1/00; A47H 1/12; E06B 9/17007; E06B 9/323
See application file for complete search history.

(56) References Cited

U.S. PATENT DOCUMENTS

| | | | | | |
|---|---|---|---|---|---|
| 1,333,326 | A | * | 3/1920 | Mclean | A47H 7/02 211/103 |
| 2,463,271 | A | * | 3/1949 | Hodges | A47H 7/02 160/111 |
| 2,565,280 | A | * | 8/1951 | Tapp | A47H 7/02 211/103 |
| 2,568,498 | A | * | 9/1951 | Hess | A47H 7/02 211/103 |
| 3,005,557 | A | * | 10/1961 | Lundquist | A47H 7/02 211/103 |
| 3,120,895 | A | * | 2/1964 | Mahana | A47H 7/02 211/103 |
| 3,416,672 | A | * | 12/1968 | Kohaut | A47H 5/14 211/103 |

(Continued)

FOREIGN PATENT DOCUMENTS

| | | | | |
|---|---|---|---|---|
| DE | 1301882 B | * | 8/1969 | A47H 11/06 |
| DE | 3139202 A1 | * | 4/1983 | A47H 7/02 |

(Continued)

*Primary Examiner* — Johnnie A. Shablack
(74) *Attorney, Agent, or Firm* — Jake K. Lee

(57) ABSTRACT

The present invention relates to a shade suspension apparatus. The shade suspension apparatus has the effects of obviating the inconvenience of a worker of having to climb to a shade to perform a replacement work when replacing the shade, etc., and preventing a safety accident which may occur when the worker performs the replacement work on a pedestal.

9 Claims, 6 Drawing Sheets

(56) References Cited

U.S. PATENT DOCUMENTS

| | | | | | |
|---|---|---|---|---|---|
| 4,091,857 | A * | 5/1978 | Jacobs | A47H 1/18 | 160/330 |
| 5,520,236 | A * | 5/1996 | Thomas | E06B 9/04 | 160/120 |
| 7,624,783 | B2 * | 12/2009 | Sensenig | G02B 6/0025 | 160/120 |
| 9,879,477 | B2 * | 1/2018 | Anderson | E06B 9/386 | |
| 2014/0209255 | A1 * | 7/2014 | Degiovanni | A47H 7/02 | 160/84.01 |
| 2019/0216250 | A1 * | 7/2019 | Choi | A47H 1/124 | |

FOREIGN PATENT DOCUMENTS

| | | | | | |
|---|---|---|---|---|---|
| DE | 3621070 | A1 * | 1/1988 | A47H 7/02 | |
| DE | 4423490 | A1 * | 1/1996 | A47H 7/02 | |
| DE | 29604998 | U1 * | 7/1996 | A47H 7/02 | |
| DE | 29714918 | U1 * | 10/1997 | A47H 7/02 | |
| EP | 1245174 | A2 * | 10/2002 | A47H 11/00 | |
| EP | 2014203 | A1 * | 1/2009 | A47H 7/02 | |
| EP | 2014203 | B1 * | 3/2013 | A47H 7/02 | |
| FR | 1506160 | A * | 12/1967 | E06B 9/76 | |
| FR | 1575734 | A * | 7/1969 | A47H 7/02 | |
| FR | 2471169 | A1 * | 6/1981 | A47H 7/02 | |
| GB | 1158731 | A * | 7/1969 | A47H 5/00 | |
| GB | 1202053 | A * | 8/1970 | A47H 7/02 | |
| GB | 2066053 | A * | 7/1981 | A47H 7/02 | |
| GB | 2359733 | B * | 10/2003 | A47H 1/10 | |
| JP | 2011038320 | A * | 2/2011 | | |
| JP | 2011143234 | A * | 7/2011 | | |
| JP | 4995762 | B2 * | 8/2012 | | |
| KR | 20100121297 | A * | 11/2010 | | |
| WO | WQ-2010050661 | A1 * | 5/2010 | A47H 7/02 | |

* cited by examiner

SHADE SUSPENSION APPARATUS

CROSS-REFERENCE TO RELATED APPLICATIONS

This application is a national stage application of International Patent Application No. PCT/KR2017/010813 filed on Sep. 28, 2017, which claims priority to Korean Patent Application No. 10-2016-0128823 filed on Oct. 6, 2016 and Korean Patent Application No. 10-2017-0024673 filed on Feb. 24, 2017, the entire contents of which are incorporated by reference herein.

TECHNICAL FIELD

The present invention relates to a shade suspension apparatus. More particularly, the shade suspension apparatus includes: a hanger disposed on a portion of a ceiling adjoining a wall; a main housing including winding reels on which suspension cords suspending a shade are wound, a rotary body to which a pulling cord is connected, and a rotary shaft to which the winding reels and the rotary body are connected; an auxiliary housing having a suspension member connected to predetermined ends of the suspension cords and an opening/closing member supporting the suspension member; and an opening/closing controller for opening and closing the opening/closing member.

BACKGROUND

In general, a shade refers to a curtain, a blind, or the like for shutting out sunlight, which is suspended on a hanger disposed on a window of a house, a building, or the like.

However, in a shade suspension apparatus of the related art, in the case of shade replacement, a worker must climb on a platform or the like to replace a shade, since the shade is suspended on a ceiling. This is not only inconvenient, but also is hazardous in that the worker may fall down from the platform while replacing the shade.

SUMMARY

Accordingly, the present invention has been made keeping in mind the above problems occurring in the prior art, and an object of the present invention is to provide a shade suspension apparatus including: a hanger disposed on a portion of a ceiling adjoining a wall; a main housing including winding reels on which suspension cords suspending a shade are wound, a rotary body to which a pulling cord is connected, and a rotary shaft to which the winding reels and the rotary body are connected; an auxiliary housing having a suspension member connected to predetermined ends of the suspension cords and an opening/closing member supporting the suspension member; and an opening/closing controller for opening and closing the opening/closing member. According to the shade suspension apparatus, in the shade suspension apparatus according to the invention as set forth above, when a shade or the like on the shade rod is to be replaced, it is possible to drop the suspension member, as well as the awning rod, by opening the opening/closing member of the auxiliary housing, so that the shade or the like can be replaced on the floor or ground. After completion of the replacement, it is possible to lift the shade rod by pulling the pulling cord, so that the shade rod returns to the original position.

Another object of the present invention is to provide a shade suspension apparatus in which two shafts extending in a top-bottom direction are provided within an inner space of the main housing, and the rotary body and the winding reels are separately provided on the shafts. This can reduce the lateral width compared to a structure having a rotary shaft and winding reels provided on a single shaft, facilitate a balancing operation, and reduce the length of portions exposed externally.

In addition, another object of the present invention is to provide a shade suspension apparatus in which the rotary shaft and the winding reels are separately provided on the shafts so as to rotate by power transferred thereto through gear engagement. An area in which rotational power is transferred is more limited compared to a structure in which rotation is performed on a single shaft. The rotary shaft and the winding reels can be rotated with a relatively small amount of power, thereby improving the efficiency of operation.

According to an embodiment of the present invention for realizing at least one of the foregoing objects, provided is a shade suspension apparatus.

The shade suspension apparatus may include:

a hanger disposed on a portion of a ceiling adjoining a wall, and having a plurality of guide rollers therein;

a main adjustor including: a main housing disposed on a portion of the wall below the hanger and having an inner space; a rotary shaft axially rotating in the inner space of the main housing; a rotary body axially attached to one portion of the rotary shaft to rotate about and integrally with the rotary shaft in response to a pulling cord being manipulated; a plurality of winding reels axially attached to the other portion of the rotary shaft to rotate about and integrally with the rotary shaft, with suspension cords guided by guide rollers of the hanger and connected to a shade rod being wound on an outer circumferential surface thereof; and a control brake connected to one end of the rotary body to control axial rotation speed of the rotary body;

a plurality of sub-adjustors disposed on the wall to be spaced apart from each other by predetermined distances, wherein each of the plurality of sub-adjustors includes: an auxiliary housing having an inner space, an open hole in an outer circumferential surface, and a guide roller in the inner space; a suspension member, with a top end thereof being connected to a corresponding suspension cord of the suspension cords guided by the guide rollers, and a bottom end thereof being connected to the shade rod; an opening/closing member supporting the suspension member to be disposed within the auxiliary housing or releasing supporting the suspension member such that the suspension member drops downwards; and a fastener coupled to a top end of the auxiliary housing and attached to the ceiling; and an opening/closing controller controlling opening and closing of the opening/closing member.

In addition, in the shade suspension apparatus, a driving gear may be axially attached to the other portion of the rotary shaft to rotate about and integrally with the rotary shaft, a shaft may be disposed at a distance from an upper portion of the rotary shaft to rotate within the inner space of the main housing, a plurality of winding reels may be axially attached to one portion of the shaft to rotate about and integrally with the shaft, with suspension cords guided by guide rollers of the hanger and connected to a shade rod being wound on an outer circumferential surface thereof, and a driven gear may be axially attached to the other portion of the shaft to rotate about and integrally with the shaft. Two shafts, i.e. the shaft and the rotary shaft may be separately provided to operate through gear engagement.

In the shade suspension apparatus according to an embodiment of the present invention, a pair of movement-preventing plates may be provided on the rotary shaft, on both sides of the rotary body, to prevent the rotary body from freely moving toward the rotary shaft.

In addition, in the shade suspension apparatus according to an embodiment of the present invention, the control brake may include: a friction sheet connected to one end portion of the rotary shaft and having a pressing head; a leaf spring having a pressing piece provided on a peripheral portion of an upper central through-hole to press the pressing head of the friction sheet, threads provided on a bottom end, and a tight contact plate extending downward at an angle from an upper peripheral portion to be in tight contact with a bottom surface of the main housing; and a control cap having a control knob disposed outside of the main housing to rotate forwards and backwards and a screw engagement portion provided on one side surface of the control knob to screw-engage with the threads of the left spring.

In addition, in the shade suspension apparatus according to an embodiment of the present invention, a transfer plate may be further provided to be sandwiched between the friction sheet and the pressing piece to transfer frictional pressure from the pressing piece to the friction sheet.

In addition, in the shade suspension apparatus according to an embodiment of the present invention, the suspension member of the auxiliary housing may be provided with a height-adjusting means for adjusting the height of the suspension cords and the awning rod.

In addition, in the shade suspension apparatus according to an embodiment of the present invention, the height-adjusting means may include female threads provided in a top portion of the suspension member and a height-adjusting member connected to predetermined ends of the suspension cords, with male threads being provided on an outer circumference surface of the height-adjusting member to screw-engage with the female threads, such that tightening and untightening the height-adjusting member moves the suspension member up and down, thereby adjusting a height of the shade rod.

In addition, in the shade suspension apparatus according to an embodiment of the present invention, the auxiliary housing may have a circular tube structure, with the through portion being provided in the bottom surface. In the opening/closing member, one end thereof is connected to a portion of the bottom surface of the auxiliary housing 31 via a hinge shaft, while the other end thereof is provided as a free end structure. The other end of the opening/closing member may be connected to the other portion of the bottom surface of the auxiliary housing via a spring. A support piece may be provided on a portion of the inner circumference of the opening/closing member to protrude toward the through portion of the auxiliary housing to support the suspension member. In response to the opening/closing controller being manipulated, the opening/closing member may be spread with respect to a hinge shaft to be winder than the through portion of the auxiliary housing. This may release supporting the suspension member is released, thereby causing the suspension member to drop.

In addition, in the shade suspension apparatus according to an embodiment of the present invention, the open/close controller may include an auxiliary pulley disposed adjacent to the auxiliary housing and the opening cord hung on the auxiliary pulley, with one end thereof being connected to a portion of the outer circumference of the opening/closing member and the other end thereof being connected to a knob. When the knob is pulled, the opening/closing member may be spread with respect to the hinge shaft to open the through portion so that the suspension member drops. When pulling the knob is released, the original position may be restored due to restoring force of the spring.

In addition, in the shade suspension apparatus according to an embodiment of the present invention, the rotary body may have a ratchet structure. When the pulling cord is pulled, the ratchet structure may allow the suspension cords to be pulled. Then, a suspension member below the suspension cords may push an opening/closing member outwards while moving upwards from a lower position to spread a through portion. When the suspension member has entered the auxiliary housing, the opening/closing member may be returned to the original position by restoring force of a spring, thereby supporting the suspension member. When the through portion is opened by spreading the opening/closing member by pulling an opening cord, the suspension cords may be automatically unwound by the weight of the awning rod and be guided downwards along with the awning rod.

As described above, the shade suspension apparatus according to the present invention obtains the following effects.

In the shade suspension apparatus according to the invention as set forth above, when a shade or the like on the shade rod is to be replaced, it is possible to drop the suspension member, as well as the awning rod, by opening the opening/closing member of the auxiliary housing, so that the shade or the like can be replaced on the floor or ground. After completion of the replacement, it is possible to lift the shade rod by pulling the pulling cord, so that the shade rod returns to the original position.

It is therefore possible to remove the inconvenience of a worker climbing on a platform or the like when replacing a shade, prevent an accident that may occur during the replacement performed on the platform, and rapidly and conveniently perform the replacement on the floor or ground.

In addition, since each sub-adjustor is provided as a single module, a plurality of sub-adjustors can be attached to the ceiling at predetermined distances. It is possible to freely locate the shade, and manufacturing and packaging of products are facilitated.

DETAILED DESCRIPTION OF THE DISCLOSURE

Figure 1:
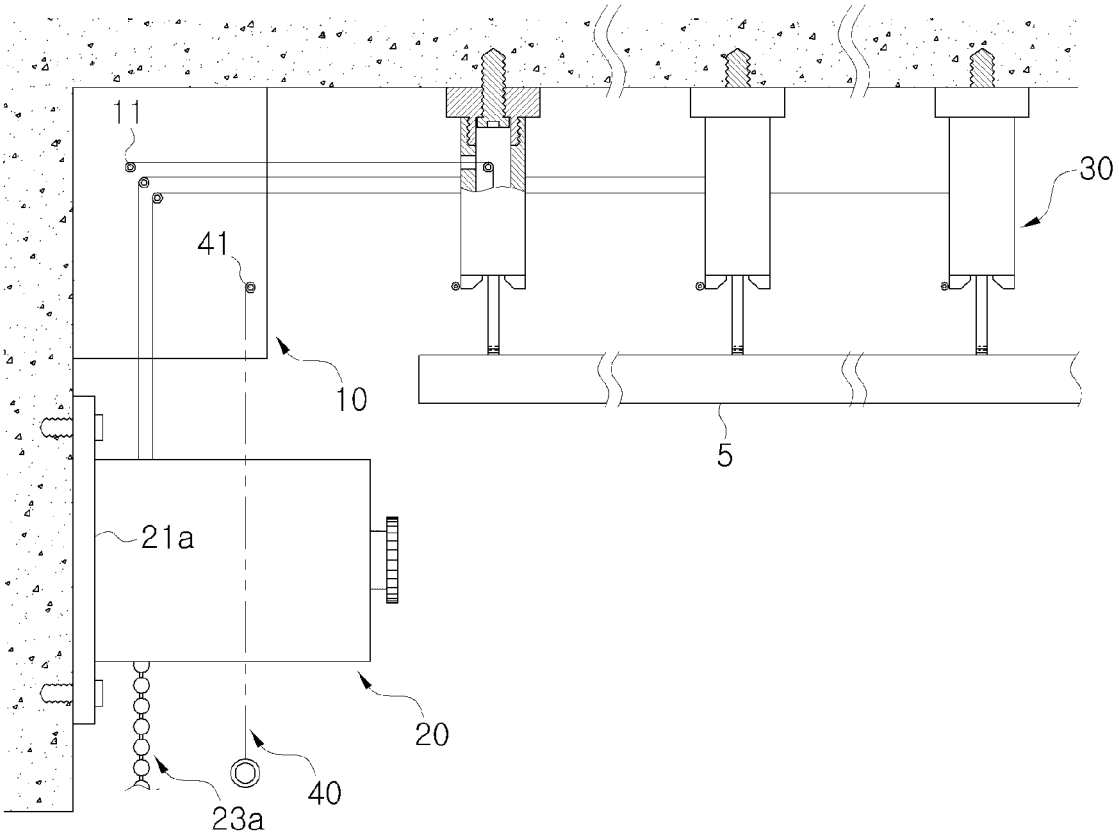
FIG. 1 is a schematic front elevation view illustrating a shade suspension apparatus according to an embodiment of the present invention.
Figure 2:
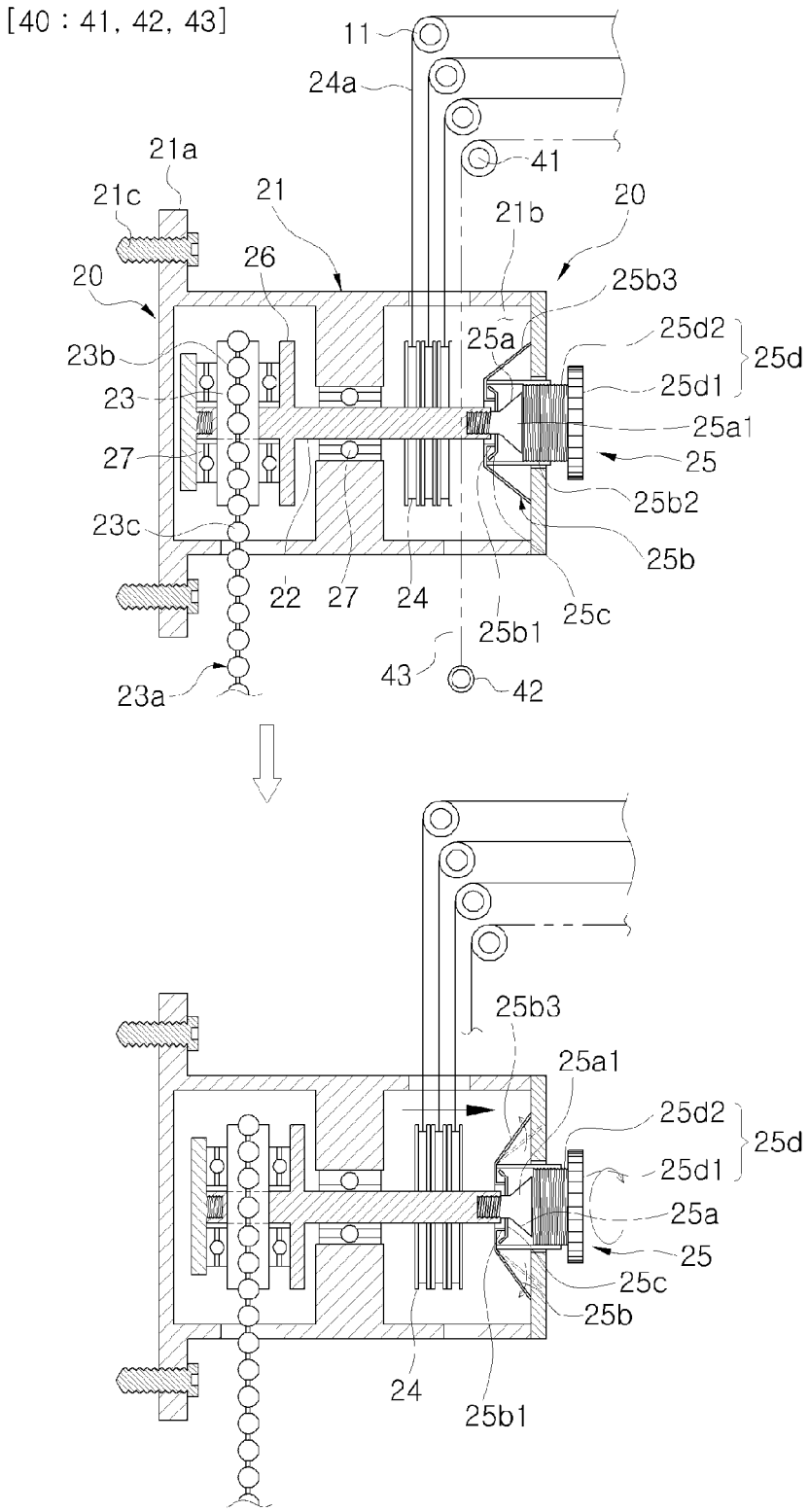
FIG. 2 is a schematic cross-sectional view illustrating the operating state of the main adjustor of the shade suspension apparatus according to an embodiment of the present invention.
Figure 3:
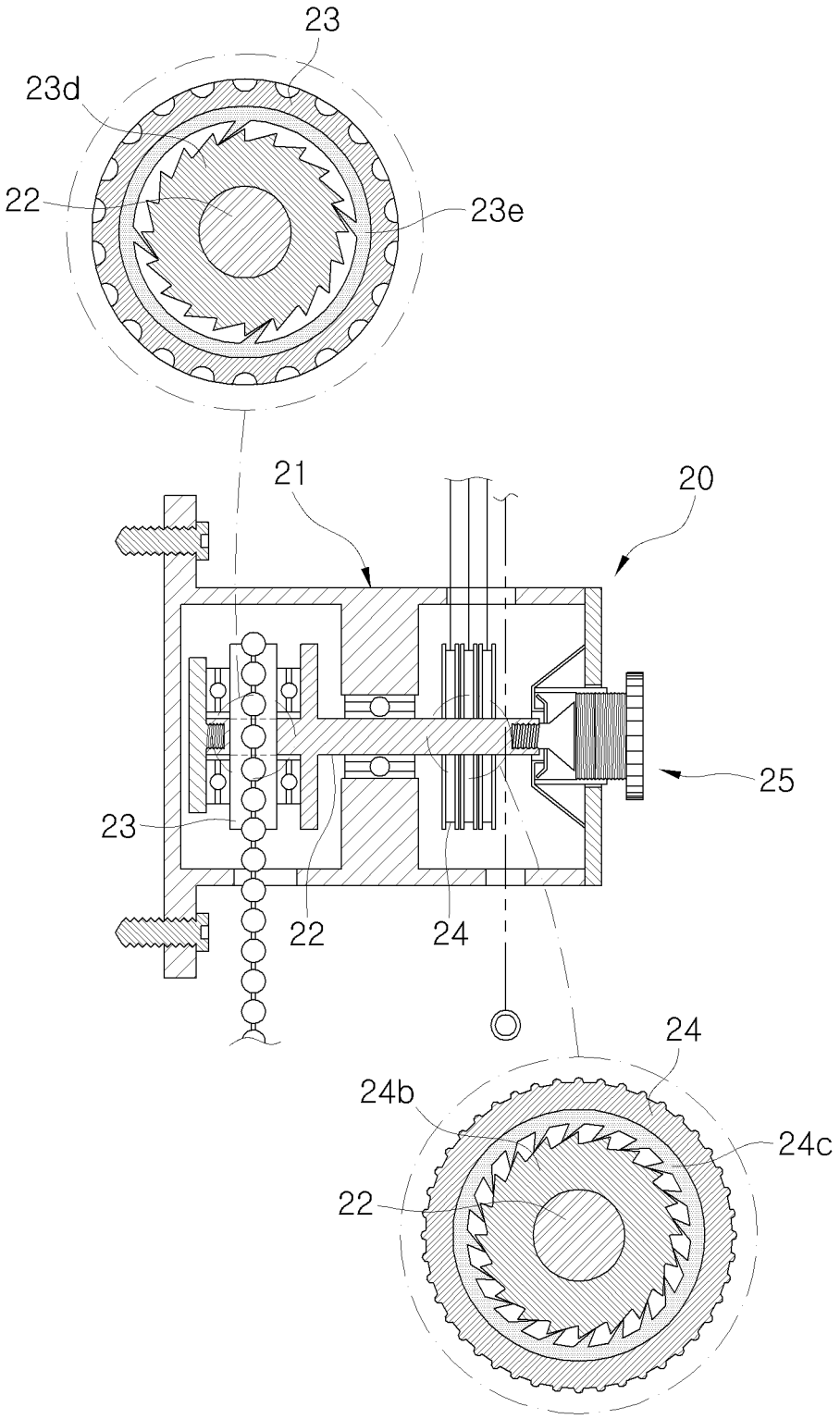
FIG. 3 is a schematic cross-sectional view illustrating the configuration for operating the rotary body and the winding reels.

Hereinafter, the present invention will be described with reference to the accompanying drawings.

As illustrated in FIGS. 1 to 6, a shade suspension apparatus includes a hanger 10, a main adjustor 20, sub-adjustors 30, and an opening/closing controller 40.

The hanger 10 is disposed on a portion of the ceiling adjoining a wall, and has a plurality of guide rollers 11 therein.

The hanger 10 is provided with a bracket integrally provided therewith and bolts fastened to the bracket to be hammered into a ceiling, a wall, or the like. For example, that the hanger 10 and the bracket may be connected via a hinge such that the hanger 10 pivots about the hinge.

The adjustor 20 includes a cylindrical main housing 21, a rotary shaft 22, a rotary body 23, a plurality of winding reels 24, and a control brake 25. The cylindrical main housing 21 has an inner space 21*b*. The rotary shaft 22 axially rotates in the inner space 21*b* of the main housing 21. The rotary body 23 is axially attached to one portion of the rotary shaft 22 to rotate about and integrally with the rotary shaft 22 in response to a pulling cord 23*a* being manipulated. The plurality of winding reels 24 are axially attached to the other portion of the rotary shaft 22 to rotate about and integrally with the rotary shaft 22, with suspension cords 24*a* guided by guide rollers 11 of the hanger 10 and connected to a shade rod 5 being wound thereon. The control brake 25 is connected to one end of the rotary body 23 to control axial rotation speed of the rotary body 23.

An integral main bracket 21*a* is provided on one end of the main housing 21, and main bolts 21*c* are fastened to the main bracket 21*a* to be inserted into the wall, such that the main adjustor 20 is fixedly attached to the wall.

In addition, a pair of movement-preventing plates 26 is provided on the rotary shaft 22, on both sides of the rotary body 23, to prevent the rotary body 23 from freely moving toward the rotary shaft 22.

In the pair of movement-preventing plates 26, one movement-preventing plate 26 is screw-coupled to one end of the rotary shaft 22, while the other movement-preventing plate 26 is in the shape of a plate member integrally connected to the rotary shaft 22.

In addition, the rotary body 23 may include an inner gear 23*d* axially attached to the rotary shaft 22 and an outer gear 23*e* surrounding the outer circumference of the inner gear 23*d*. The rotary body 23 may have a ratchet structure in which the inner gear 23*d* and the outer gear 23*e* engage with each other. When the pulling cord 23*a* is pulled (in which case the outer gear rotates the inner gear axially attached to the rotary shaft), the suspension cords 24*a* are pulled. Then, a suspension member 32 below the suspension cords 24*a* pushes an opening/closing member 33 outwards while moving upwards from a lower position to spread a through portion 31*d*. When the suspension member 32 has entered the auxiliary housing 31, the opening/closing member 33 is returned to the original position by restoring force of a spring 36, thereby supporting the suspension member 32. When the through portion 31*d* is opened by spreading the opening/closing member 33 by pulling an opening cord 43, the ratchet structure may allow the suspension cords 24*a* to be automatically unwound by the weight of the shade rod 5 (in which the inner gear rotates while the outer gear remains stopped) to be guided downwards along with the shade rod 5.

Reference numeral 27 indicates a bearing configured to smoothen movement between the rotary body 23 and the movement-preventing plate 26 and between the rotary shaft 22 and the main housing 21.

Reference numeral 23*b* indicates concave recesses provided in the outer circumference of the rotary body 23, while 23*c* indicates latching beads configured to be latched to the concave recesses 23*a* in response to the pulling cord 23*c* being pulled, thereby allowing the rotary body 23 to smoothly rotate.

Here, it is apparent that a typical anti-release cap (not shown) is provided outside of the pulling cord 23*a* to prevent the pulling cord from being released outwards while being manipulated.

The control brake 25 includes a friction sheet 25*a*, a leaf spring 25*b*, and a control cap 25*d*. The friction sheet 25*a* is connected to one end portion of the rotary shaft 22 and having a pressing head 25*a*1. The leaf spring 25*b* has a pressing piece 25*b*1 provided on the periphery of an upper central through-hole to press the pressing head 25*a*1 of the friction sheet 25*a*, threads 25*b*2 provided on a bottom end, and a tight contact plate 25*b*3 extending downward at an angle from the upper periphery to be in tight contact with a bottom surface of the main housing 21. The control cap 25*d* has a control knob 25*d*1 disposed outside of the main housing 21 to rotate forwards and backwards and a screw engagement portion 25*d*2 provided on one side surface of the control knob 25*d*1 to screw-engage with the threads 25*b*2 of the left spring 25*b*.

A transfer plate 25*c* is sandwiched between the friction sheet 25*a* and the pressing piece 25*b*1 to transfer frictional pressure from the pressing piece 25*b*1 to the friction sheet 25*a*.

In addition, in the main adjustor 20, the main housing 21 and the main bracket 21*a* are integrally provided. For example, the main housing 11 and the main bracket 21*a* may be coupled via a hinge, such that the main housing 11 pivots about the hinge.

Each of the sub-adjustors 30 includes the auxiliary housing 31, the suspension member 32, and opening/closing member 33. The auxiliary housing 31 has an inner space 31*a*, an open hole 31*b* in a portion of the outer circumference, and a guide roller 31*c* in the inner space 31*a*. In the suspension member 32, the top end thereof is connected to the corresponding suspension cord 24*a* guided by the guide rollers 31*c*, and the bottom end thereof is connected to the shade rod 5. The opening/closing member 33 supports the suspension member 32 to be disposed within the auxiliary housing 31 or releases supporting the suspension member 32 such that the suspension member 32 drops downwards.

Each of the sub-adjustors 30 further includes a fastener 34 coupled to the top end of the auxiliary housing 31 and attached to the ceiling.

A spiral portion 31*e* is provided on the inner circumference of the auxiliary housing 31, adjacent to the upper portion of the inner space 31*a*.

The fastener 34 includes a rod 34*a* inserted into the inner space 31*a* of the auxiliary housing 31, a corresponding spiral portion 34*b* provided on the outer circumference of the rod 34*a* to be engaged with the spiral portion 31*e*, a head 34*c* extending upward from the rod 34*a* to be seated around the top portion of the inner space 31*a*, an inner hole 34*d* extending through the rod 34*a* and the head 34*c* in a top-bottom direction, and a fixing bolt 34*e* fitted into the ceiling through the inner hole 34*a*.

Since the plurality of sub-adjustors 30 are attached to the ceiling using the fasteners 34 to be spaced apart from each other by predetermined distances, it is easy to set attachment positions and distances thereof at sites.

In addition, the suspension member 32 of the auxiliary housing 31 is provided with a height-adjusting means for adjusting the height of the suspension cords 24*a* and the shade rod 5.

The height-adjusting means includes female threads 32*a* provided in the top portion of the suspension member 32 and a height-adjusting member 35 connected to predetermined ends of the suspension cords 24*a* and having male threads 35*a* provided on the outer circumference of thereof to screw-engage with the female threads 32*a*. Tightening and untightening the height-adjusting member 35 moves the suspension member 32 up and down, thereby adjusting the height of the shade rod 5.

The auxiliary housing 31 has a circular tube structure, with the through portion 31*d* being provided in the bottom surface. In the opening/closing member 33, one end thereof is connected to a portion of the bottom surface of the auxiliary housing 31 via a hinge shaft, while the other end thereof is provided as a free end structure. The other end of the opening/closing member 33 is connected to the other portion of the bottom surface of the auxiliary housing 31 via a spring 36. A support piece 33*b* is provided on a portion of the inner circumference of the opening/closing member 33 to protrude toward the through portion 31*d* of the auxiliary housing to support the suspension member 32. In response to the opening/closing controller 40 being manipulated, the opening/closing member 33 is spread with respect to a hinge shaft 33*a* to be winder than the through portion 31*d* of the auxiliary housing 31. This can release supporting the suspension member 32, thereby causing the suspension member 32 to drop.

The opening/closing controller 40 is intended to control opening/closing of the opening/closing member 33. The opening/closing controller 40 includes an auxiliary pulley 41 disposed adjacent to the auxiliary housing 31 and the opening cord 43 hung on the auxiliary pulley 41, with one end thereof being connected to a portion of the outer circumference of the opening/closing member 33 and the other end thereof being connected to a knob 42. When the knob 42 is pulled, the opening/closing member 33 is spread with respect to the hinge shaft 33*a* to open the through portion 31*d* so that the suspension member 32 drops. When pulling the knob 42 is released, the original position is restored due to restoring force of the spring 36.

The auxiliary pulley 41 is disposed within the hanger 10, and the opening cord 43 is guided by the auxiliary pulley 41 to pass through an inlet hole 29D of the main adjustor 20, thereby being exposed from the bottom of the main adjustor 20.

Hereinafter, a process of operating the shade suspension apparatus according to an embodiment of the present invention will be described.

First, in an event of replacing a curtain (not shown) hung on the shade rod 5, the knob 42 of the opening/closing controller 40 is pulled. Then, the other end of the opening/closing member 33 connected to the end of the opening cord 43 is spread with respect to the hinge shaft 33*a*. Consequently, the suspension member 32 moves downwards, causing the shade rod 5 to move downwards.

Here, the suspension cords 24*a* are unlocked by the rotary body 23 having the ratchet structure to freely move, thereby automatically dropping the suspension member.

The dropping speed of the suspension member 32 is controlled by the control brake 25. For example, when the leaf spring 25*b* is pulled by tightening the control cap 25*d*, the pressing piece 25*b*1 presses the transfer plate 25*c* and subsequently presses the pressing head 25*a*1 of the friction sheet 25*a* connected to the rotary shaft 22, thereby decelerating axial rotation speed of the rotary shaft 22. In contrast, when pulling the leaf spring 25*b* is released, the axial rotation speed of the rotary shaft 22 is accelerated.

In the case of returning to the original position after replacement of the curtain dropped to the floor or ground, the pulling cord 23*a* is pulled, thereby causing the shade rod 5 to move upwards together with the shade rod 5. When the suspension member 32 enters the through portion 31*d* after opening the through portion 31*d* by pushing the opening/closing member 33, the spread opening/closing member 33 is returned to the original position by the spring 36 to support the bottom of the shade rod 5. In this manner, the shade rod 5 is returned to the original position.

Hereinafter, a shade suspension apparatus according to another embodiment of the present invention will be described.

Figure 4:
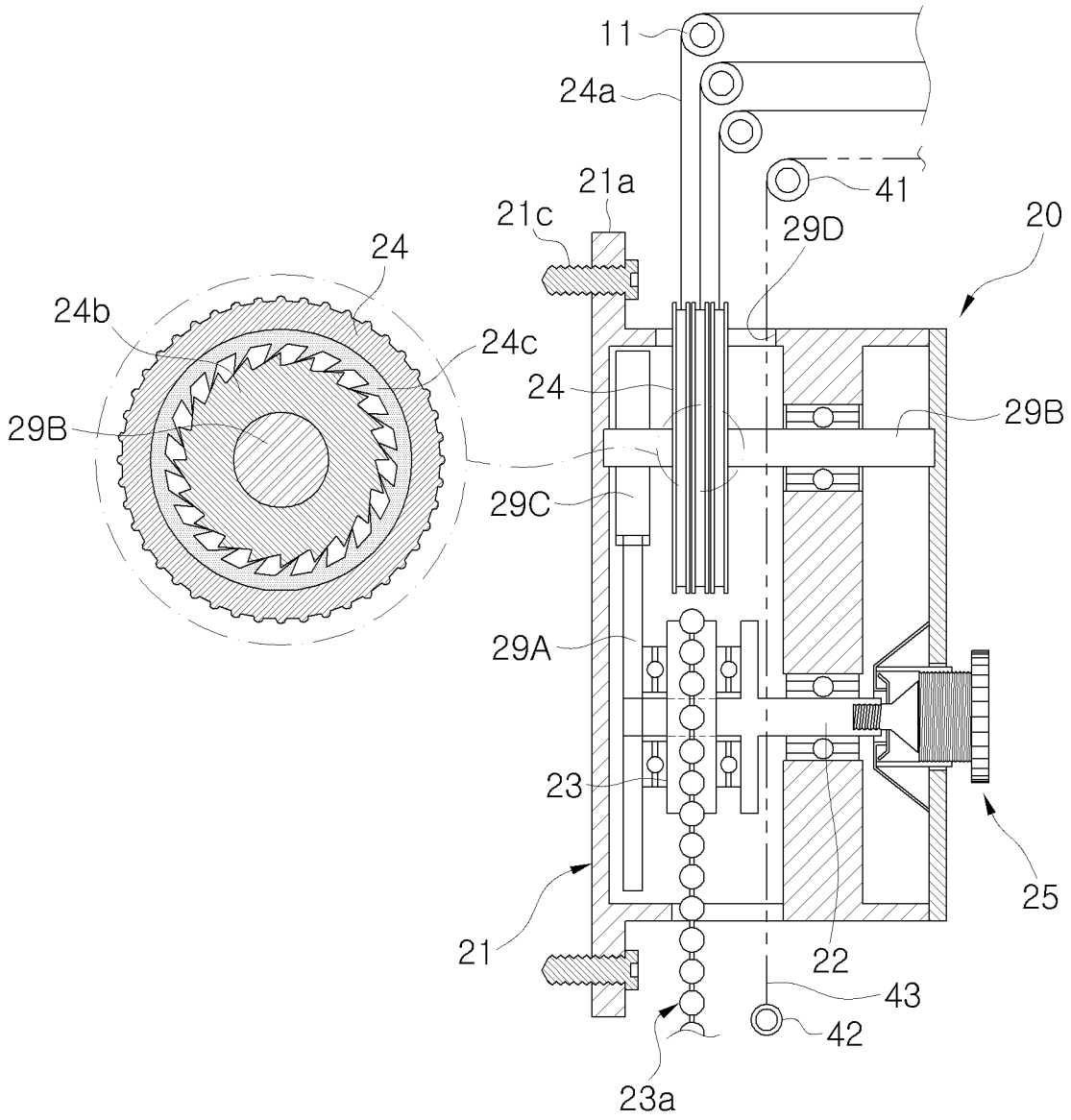
FIG. 4 is a schematic front elevation view illustrating a shade suspension apparatus according to another embodiment of the present invention.
Figure 5:
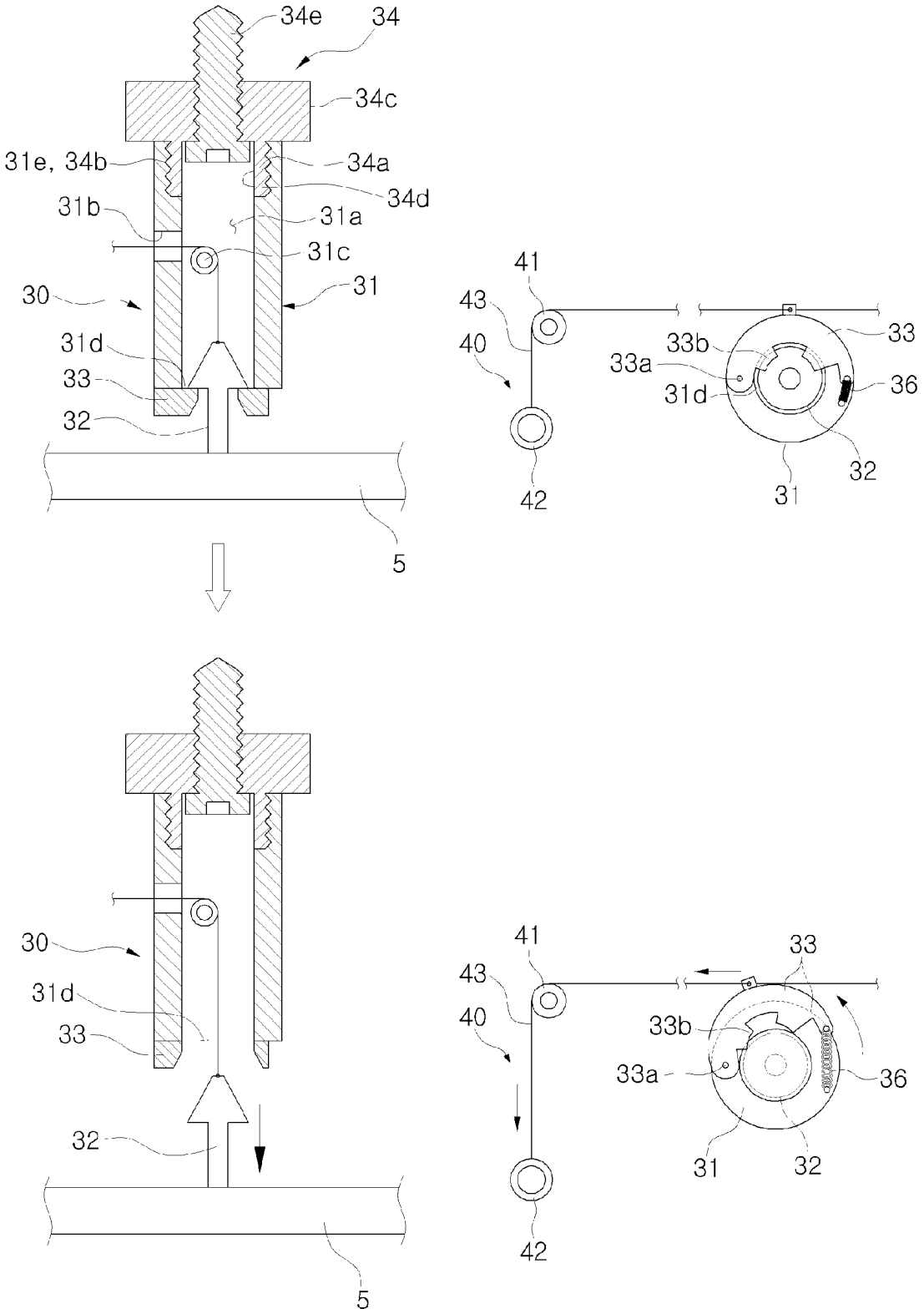
FIG. 5 is a schematic cross-sectional view illustrating the operating state of the main adjustor of the shade suspension apparatus according to embodiments of the present invention.
Figure 6:
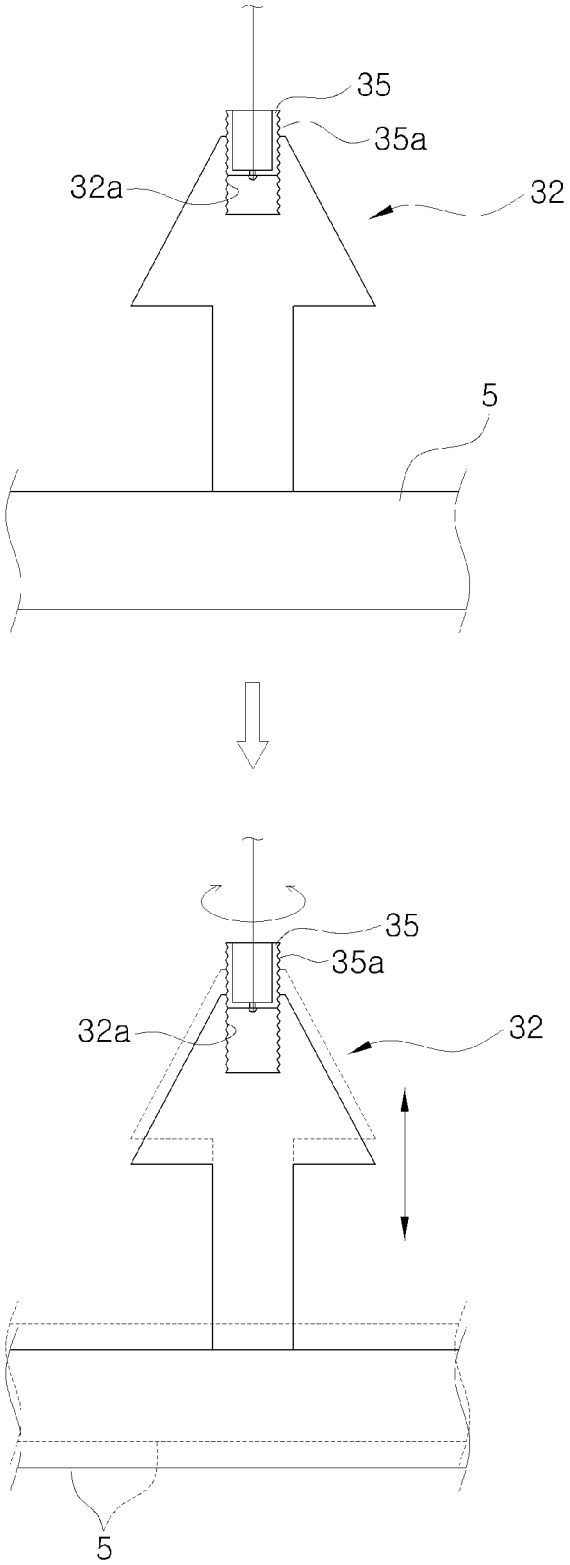
FIG. 6 is a schematic cross-sectional view illustrating the operation of adjusting the height of the shade rod of the shade suspension apparatus according to embodiments of the present invention.

The shade suspension apparatus according to another embodiment is illustrated in FIG. 4.

The shade suspension apparatus further includes a driving gear 29A, a shaft 29B, and a driven gear 29C.

The driving gear 29A is axially attached to the other portion of the rotary shaft 22 to rotate about and integrally with the rotary shaft 22.

The shaft 29B is disposed at a distance from the upper portion of the rotary shaft 22 to rotate in the inner space 21*b* of the main housing 21.

The driven gear 29C is axially attached to the other portion of the shaft 29B to rotate about and integrally with the shaft 29B, and engages with the driving gear 29A.

Here, the plurality of winding reels 24 are axially attached to the shaft 29B instead of the rotary shaft 22 so as to rotate integrally with the shaft 29B.

One of the movement-preventing plates 26 may be exposed externally, with the driving gear 29A being coupled thereto or the rotary shaft 22 extending therefrom, and the driving gear 29A may be coupled to the exposed end.

In addition, since the rotary shaft 22 having the driving gear 29A moves laterally in response to the control brake 25 being manipulated, the lateral width of teeth of the driven gear 29C engaging with the driving gear 29A may be greater than the lateral width of teeth of the driving gear 29A. This configuration is intended to prevent the driving gear 29A from disengaging from the driven gear 29C or the area of engagement between the driving gear 29A and the driven gear 29C from decreasing when the driving gear 29A moves.

Then, when the rotary body 23 rotates in response to the pulling cord 23*a* being manipulated, the driving gear 29A provided on the rotary body 23 and the driven gear 29C provided on the shaft 29B rotate in concert with each other, so that the shaft 29B and the plurality of winding reels 24 coupled to the shaft 29B rotate, thereby winding or unwinding the suspension cords 24*a*.

In the shade suspension apparatus according to embodiments of the present invention, The inlet hole 29D, through which the suspension cords 24*a* enter, is provided in the main housing 21 to penetrate the main housing 21 through the inside and outside of the main housing 21. The inlet hole 29D is located adjacent to top portions of the winding reels 24.

Top ends of the winding reels 24 exposed externally beyond the inlet hole 29D.

Each of the winding reels 24 includes an inner gear 51 axially attached to the shaft 29B and an outer gear 52 engaging with the inner gear 51 in a ratchet structure.

Since the top ends of the winding reels 24 are exposed externally beyond the inlet hole 29D and the inner gear 51 and the outer gear 52 engaged in the ratchet structure are disposed within each of the winding reels 24, a user can adjust the height of the shade rod 5 by moving the suspension member 32 up and down by manually turning the winding reels 24 using the externally-exposed top ends of the winding reels 24, as in the case of using the height-adjusting means.

In addition, the outer gear 52 is integrally coupled to each interior of the winding reels 24. In particular, the outer gear 52 is made of a flexible material. Accordingly, when the outer gear 52 rotates together with the inner gear 51 while engaging with the inner gear 51, the outer gear 52 elastically engages with the inner gear 51.

Protrusions may be provided on each outer circumference of the winding reels 24 to prevent slipping when the winding reels 24 are manually turned.

In the shade suspension apparatus according to the present invention as set forth above, when a shade or the like on the shade rod is to be replaced, it is possible to drop the suspension member, as well as the awning rod, by opening the opening/closing member of the auxiliary housing, so that the shade or the like can be replaced on the floor or ground. After completion of the replacement, it is possible to lift the shade rod by pulling the pulling cord, so that the shade rod returns to the original position. It is therefore possible to remove the inconvenience of a worker climbing on a platform or the like when replacing a shade, prevent an accident that may occur during the replacement performed on the platform, and rapidly and conveniently perform the replacement on the floor or ground.

Although the exemplary embodiments of the present invention have been described for illustrative purposes, not only simple variations obtained by combining any of the foregoing embodiments with a known technology, but also any technologies that a person skilled in the art, to which the present invention relates, can modify and use without departing from the scope and spirit of the present invention as disclosed herein and in the accompanying claims, shall be understood as being included within the scope of the present invention.

What is claimed is:

1. A shade suspension apparatus comprising:

a hanger (10) disposed on a portion of a ceiling adjoining a wall and having a plurality of guide rollers (11);

a main adjustor (20) comprising:

a main housing (21) disposed on a portion of the wall below the hanger (10) and having an inner space (21*b*);

a rotary shaft (22) axially rotating in the inner space (21*b*) of the main housing (21);

a rotary body (23) axially attached to a portion of the rotary shaft (22) and rotating integrally with the rotary shaft (22) along an axial direction when a pulling cord (23*a*) is manipulated;

a plurality of winding reels (24) axially attached to another portion of the rotary shaft (22) and rotating integrally with the rotary shaft (22) along an axial direction, wherein the winding reels are wound with suspension cords (24*a*) on an outer circumferential surface thereof, the suspension cords guided by guide rollers (11) of the hanger (10) and connected to a shade rod (5); and a control brake (25) connected to an end of the rotary body (23) to control an axial rotation speed of the rotary body (23);

a plurality of sub-adjustors (30) disposed on the wall and spaced apart from each other by a predetermined distance, wherein each of the plurality of sub-adjustors (30) comprises:

an auxiliary housing (31) having an inner space (31*a*), an open hole (31*b*) in an outer circumferential surface, and a guide roller (31*c*) in the inner space (31*a*);

a suspension member (32) with a top end connected to the corresponding suspension cord and a bottom end connected to the shade rod (5);

an opening/closing member (33) supporting or releasing the suspension member (32); and a fastener (34) coupled to a top end of the auxiliary housing (31) and attached to the ceiling; and an opening/closing controller controlling the opening/closing member (33).

2. The shade suspension apparatus according to claim 1, further comprising a height-adjusting means comprising female threads (32*a*) provided in a top portion of the suspension member (32) and a height-adjusting member (35) connected to predetermined ends of the suspension cords (24*a*), with male threads (35*a*) being provided on an outer circumference surface of the height-adjusting member (35) to screw-engage with the female threads (32*a*), such that tightening and untightening the height-adjusting member (35) moves the suspension member (32) up and down, thereby adjusting a height of the shade rod (5).

3. The shade suspension apparatus according to claim 1, wherein a spiral portion (31*e*) is provided on an inner circumferential surface of the auxiliary housing (31), adjacent to an upper portion of the inner space (31*a*), the fastener (34) comprises a rod (34*a*) inserted into the inner space (31*a*) of the auxiliary housing (31), a corresponding spiral portion (34*b*) provided on an outer circumferential surface of the rod (34*a*) to be engaged with the spiral portion (31*e*), a head (34*c*) extending upward from the rod (34*a*) to be seated around a top portion of the inner space (31*a*), an inner hole (34*d*) extending through the rod (34*a*) and the head (34*c*) in a top-bottom direction, and a fixing bolt (34*e*) fitted into the ceiling through the inner hole.

4. The shade suspension apparatus according to claim 1, wherein the control brake (25) comprises: a friction sheet (25*a*) connected to one end portion of the rotary shaft (22) and having a pressing head (25*a*1); a leaf spring (25*b*) having a pressing piece (25*b*1) provided on a peripheral portion of an upper central through-hole to press the pressing head (25*a*1) of the friction sheet (25*a*), threads (25*b*2) provided on a bottom end, and a tight contact plate (25*b*3) extending downward at an angle from an upper peripheral portion to be in tight contact with a bottom surface of the main housing (21); and a control cap (25*d*) having a control knob (25*d*1) disposed outside of the main housing (21) to rotate forwards and backwards and a screw engagement portion (25*d*2) provided on one side surface of the control knob (25*d*1) to screw-engage with the threads (25*b*2) of the left spring (25*b*).

5. A shade suspension apparatus comprising:

a hanger (10) disposed on a portion of a ceiling adjoining a wall, and having a plurality of guide rollers (11);

a main adjustor (20) comprising:

a main housing (21) disposed on a portion of the wall below the hanger (10) and having an inner space (21*b*);

a rotary shaft (22) axially rotating in the inner space (21*b*) of the main housing (21);

a rotary body (23) axially attached to a portion of the rotary shaft (22) and rotating integrally with the rotary shaft (22) along an axial direction when a pulling cord (23*a*) is manipulated;

a driving gear (29A) axially attached to another portion of the rotary shaft (22) and rotating integrally with the rotary shaft (22) along an axial direction;

a shaft (29B) disposed at a distance from an upper portion of the rotary shaft (22) and rotating within the inner space (21*b*) of the main housing (21);

a plurality of winding reels (24) axially attached to a portion of the shaft (29B) and rotating integrally with the shaft (29B) along an axial direction, wherein the winding reel are wound with suspension cords (24*a*) on an outer circumferential surface, the suspension cords guided by guide rollers (11) of the hanger (10) and connected to a shade rod (5);

a driven gear (29C) axially attached to another portion of the shaft (29B) and rotating integrally with the shaft (29B) along an axial direction; and a control brake (25) connected to an end of the rotary body (23) to control an axial rotation speed of the rotary body (23);

a plurality of sub-adjustors (30) disposed on the wall and spaced apart from each other by a predetermined distance, wherein each of the plurality of sub-adjustors (30) comprises:

an auxiliary housing (31) having an inner space (31*a*), an open hole (31*b*) in an outer circumferential surface, and a guide roller (31*c*) in the inner space (31*a*);

a suspension member (32) with a top end connected to the corresponding suspension cord guided by the guide rollers (31*c*) and a bottom end connected to the shade rod (5);

an opening/closing member (33) supporting or releasing the suspension member (32); and a fastener (34) coupled to a top end of the auxiliary housing (31) and attached to the ceiling; and an opening/closing controller controlling the opening/closing member (33).

6. The shade suspension apparatus according to claim 5, wherein the rotary body (23) comprises an inner gear (23*d*) axially attached to the rotary shaft (22) and an outer gear (23*e*) surrounding an outer circumferential surface of the inner gear (23*d*) and engaging with the inner gear (23*d*) in a ratchet structure, an inlet hole (29D), through which the suspension cords (24*a*) enter, is provided in the main housing (21) to penetrate the main housing (21) through an inside and outside of the main housing (21) located adjacent to top portions of the winding reels (24), each of the winding reels (24) comprises an inner gear (24*b*) attached to the shaft (29B) and an outer gear (24*c*) engaging with the inner gear (24*b*) in a ratchet structure, and top ends of the winding reels (24) are exposed externally beyond the inlet hole (29D).

7. The shade suspension apparatus according to claim 5, further comprising a height-adjusting means comprising female threads (32*a*) provided in a top portion of the suspension member (32) and a height-adjusting member (35) connected to predetermined ends of the suspension cords (24*a*), with male threads (35*a*) being provided on an outer circumference surface of the height-adjusting member (35) to screw-engage with the female threads (32*a*), such that tightening and untightening the height-adjusting member (35) moves the suspension member (32) up and down, thereby adjusting a height of the shade rod (5).

8. The shade suspension apparatus according to claim 5, wherein a spiral portion (31*e*) is provided on an inner circumferential surface of the auxiliary housing (31), adjacent to an upper portion of the inner space (31*a*), the fastener (34) comprises a rod (34*a*) inserted into the inner space (31*a*) of the auxiliary housing (31), a corresponding spiral portion (34*b*) provided on an outer circumferential surface of the rod (34*a*) to be engaged with the spiral portion (31*e*), a head (34*c*) extending upward from the rod (34*a*) to be seated around a top portion of the inner space (31*a*), an inner hole (34*d*) extending through the rod (34*a*) and the head (34*c*) in a top-bottom direction, and a fixing bolt (34*e*) fitted into the ceiling through the inner hole.

9. The shade suspension apparatus according to claim 5, wherein the control brake (25) comprises: a friction sheet (25*a*) connected to one end portion of the rotary shaft (22) and having a pressing head (25*a*1); a leaf spring (25*b*) having a pressing piece (25*b*1) provided on a peripheral portion of an upper central through-hole to press the pressing head (25*a*1) of the friction sheet (25*a*), threads (25*b*2) provided on a bottom end, and a tight contact plate (25*b*3) extending downward at an angle from an upper peripheral portion to be in tight contact with a bottom surface of the main housing (21); and a control cap (25*d*) having a control knob (25*d*1) disposed outside of the main housing (21) to rotate forwards and backwards and a screw engagement portion (25*d*2) provided on one side surface of the control knob (25*d*1) to screw-engage with the threads (25*b*2) of the left spring (25*b*).

* * * * *